United States Patent [19]

Transue et al.

[11] 4,342,272

[45] Aug. 3, 1982

[54] PRESSER BAR BIASING SPRING STRUCTURE

[75] Inventors: James A. Transue, Union; William Weisz, Tenafly, both of N.J.

[73] Assignee: The Singer Company, Stamford, Conn.

[21] Appl. No.: 81,404

[22] Filed: Oct. 3, 1979

[51] Int. Cl.[3] ..... D05B 29/02

[52] U.S. Cl. ..... 112/237

[58] Field of Search ..... 112/237, 238, 121, 78; 403/229

[56] References Cited

U.S. PATENT DOCUMENTS

| | | | |
|---|---|---|---|
| 289,687 | 12/1883 | Morris | 112/237 |
| 373,851 | 11/1887 | Post | 112/237 |
| 460,955 | 10/1891 | Diehl | 112/237 |
| 823,442 | 6/1906 | Rodman . | |
| 1,749,529 | 3/1930 | Feigel . | |
| 2,392,730 | 1/1946 | Enos | 112/237 |
| 2,422,820 | 6/1947 | Best | 112/237 |
| 2,743,690 | 5/1956 | Mayer | 112/237 |
| 2,754,783 | 7/1956 | Scott et al. | 112/237 |
| 3,055,326 | 9/1962 | Greulich . | |
| 3,093,101 | 6/1963 | Foltis et al. | 112/237 |
| 3,282,237 | 11/1966 | Niekrawietz . | |
| 3,303,804 | 2/1967 | Lesort . | |
| 3,433,193 | 3/1969 | Takahashi . | |
| 3,507,069 | 4/1970 | Borba, Sr. | 403/229 |
| 3,611,963 | 10/1971 | Herr . | |
| 3,669,050 | 6/1972 | Adams | 112/237 |
| 3,793,969 | 2/1974 | Adams . | |
| 4,044,701 | 8/1977 | Giesselmann et al. . | |

FOREIGN PATENT DOCUMENTS

| | | | |
|---|---|---|---|
| 53-141755 | 12/1978 | Japan . | |
| 652246 | 3/1979 | U.S.S.R. | 112/237 |

*Primary Examiner*—Werner H. Schroeder
*Assistant Examiner*—Andrew M. Falik
*Attorney, Agent, or Firm*—James M. Trygg; Robert E. Smith; Edward L. Bell

[57] ABSTRACT

A tension spring concentric with the presser bar pulls the presser foot down against the work. The spring is threaded onto two holders, each of which fits around the presser bar. The first holder is attached to the presser bar near its upper end but the second allows the presser bar to slide within it. The second holder is slidably attached to a bracket and controlled by a presser bar pressure regulating cam to slide up and down in the bracket and thereby change the tension in the spring to exert a controlled force on the presser foot. The first holder is also slidably mounted in the bracket, and is controlled by a lever that has a lifting cam linked to the first holder. When the lever is lifted, the first holder is lifted to raise the presser bar and presser foot away from the work. This extends the spring, which urges the presser foot back down against the work as soon as the lever is lowered.

13 Claims, 4 Drawing Figures

PRESSER BAR BIASING SPRING STRUCTURE

BACKGROUND OF THE INVENTION

A presser bar in a sewing machine transmits pressure to a presser foot at one end of the bar, and the foot transmits this pressure to the work, or material to be sewn. At times during the sewing operation, for example when one stitching operation has been finished and the work is being removed to be replaced by new material, the presser bar is moved longitudinally away (which means normally upward) from the work by means of a lever. When the operator desires to reapply pressure to the work or to begin sewing on new work, the lever is actuated in the reverse direction, and force is transmitted from a biasing spring to move the presser bar longitudinally into engagement with the work then in position to be sewn.

It is desirable that the force of the spring act as nearly precisely axially along the presser bar as is possible without exerting any side forces that would tend to pivot the presser bar about some axis more or less perpendicular to the longitudinal direction of the bar.

One way of applying pressure in the desired longitudinal direction is to place a compression spring between the upper end of the presser bar and a fixed member. Unless the diameter of the spring is large relative its length, a compression spring has a tendency to bend, displacing its central coils from alignment with coils at the ends. In a sewing machine, there is not enough space to have a very large diameter spring supply the force for the presser bar.

It is also desirable to utilize a compression spring that is relatively long, but this only exacerbates the lateral displacement of central coils of the spring. In order to limit such displacement, it has been the practice to enclose the compression spring in a hollow end of the presser bar of slightly larger inside diameter than the outside diameter of the spring. A cylinder extending into the mouth of the hollow end holds the spring in place. Although this does not entirely prevent the undesired lateral displacement, it limits such movement of the central coils and it also prevents the spring from becoming completely disengaged from either the end of the presser bar or the fixed member. However, the spring can still flex laterally enough to rub on the inner wall of the hollow tubular member, which is undesirable. In addition, the presser bar can also engage the outer surface of the cylinder due to some sidewise pressure applied to the presser foot. These limitations on the satisfactory movement of the spring and the pressor bar result in a hysteresis effect, which is also known as "stick slip".

The use of an extension spring to apply downward force to a presser bar to bias it against the work in a sewing machine has been suggested by Rodman in U.S. Pat. No. 823,442, by Feigel in U.S. Pat. No. 1,749,529, by Niekrawietz in U.S. Pat. No. 3,282,237, and by Giesselmann et al in U.S. Pat. No. 4,044,701. However, in each of those patents the force of the extension spring was not applied directly along the axis of the presser bar but was applied to one side of the axis, thereby producing a mechanical moment resulting in hysteresis.

SUMMARY OF THE INVENTION

One of the objects of the present invention is to overcome the hysteresis, or stick slip, effect on a sewing machine presser bar.

A further object is to avoid the problems caused by the use of a long, slender compression spring to apply axial force to one end of a presser bar.

A further object is to provide a simplified spring bias structure that can be manufactured easily and inexpensively and yet will provide force directed along the axis of the presser bar.

In accordance with the present invention, a simple extension spring is threaded onto two members, one of which is attached to an upper part of the presser bar and the other of which is held down by a bracket. Both the bracket and the member attached to the upper end of the spring are mounted on a second bracket to be attached to the arm of the sewing machine as a unit. A lever is also mounted on the second bracket to drive a connecting member that pushes the first member up, and thereby extends the spring, in order to raise the presser bar and presser foot. The second bracket also has bushing means mounted on it to constrain the motion of the presser bar so that it can move only longitudinally.

The amount of pressure exerted by the presser foot on the work can be controlled by controlling the distance between the first and second members. This distance, in turn, can be controlled by a cam mounted on the second bracket and applying force to the first bracket by means of a cam follower mounted on the first bracket.

Force to lift the presser bar may be transmitted from the lever by means of another cam controlled by the lever and acting on a second cam follower attached to the link that forces the first member up when the lever is pivoted to raise the presser foot.

DESCRIPTION OF THE PREFERRED EMBODIMENT

Figure 1:
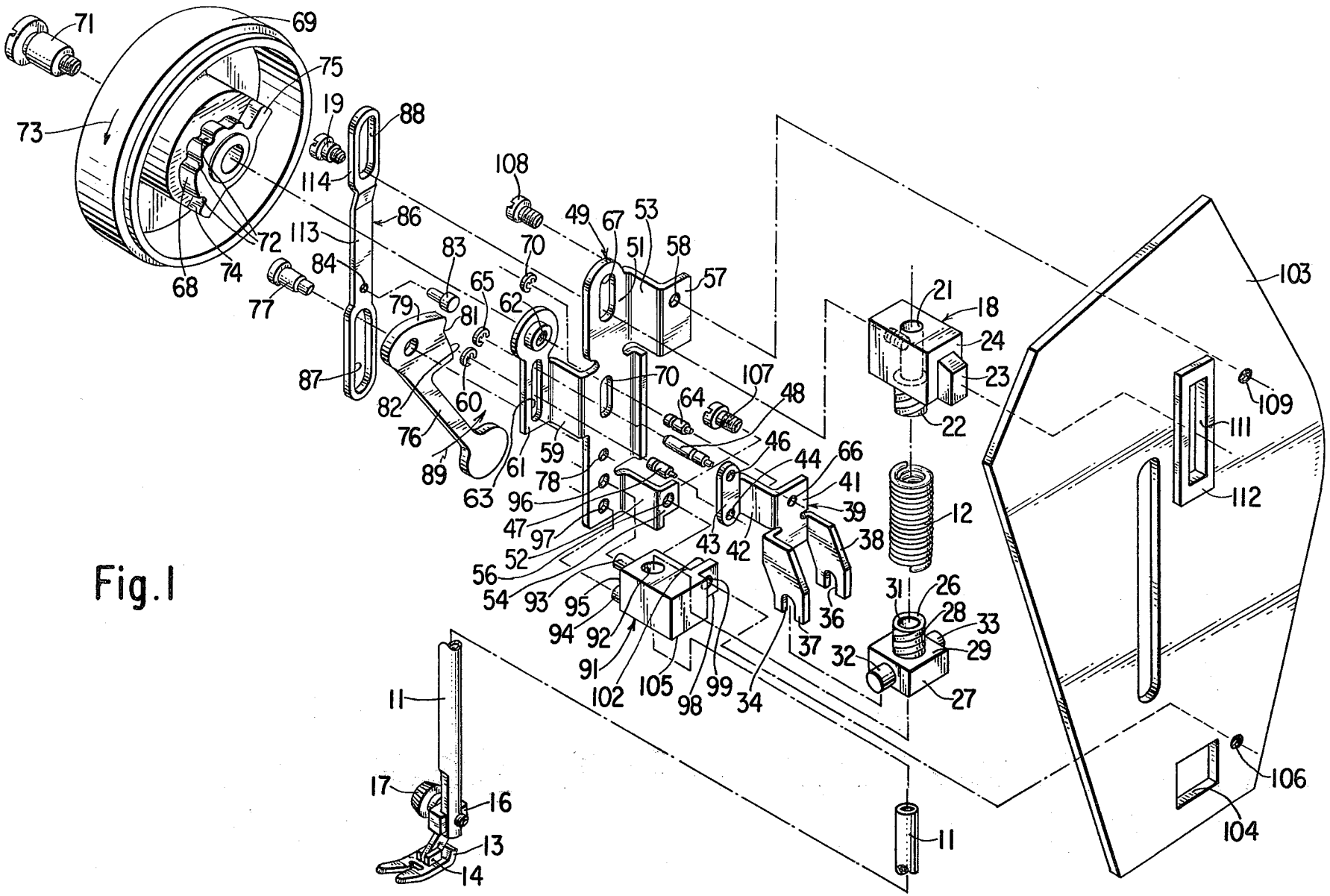
FIG. 1 is an exploded, perspective view of a presser bar actuating mechanism incorporating the present invention.

The exploded perspective view in FIG. 1 shows the components associated with a presser bar 11, which is arranged to be resiliently biased by a helical extension presser bar spring 12 that surrounds the upper part of the presser bar. The spring 12 is quite simple to manufacture, since it has plain ends without hooks or eyes. One configuration that has proved to be satisfactory consists of twenty-two closely wound coils of ASTM A-228 music steel spring wire wound so that the spring has an inner diameter of 10.2 mm. The bar 11 is generally cylindrical with a round cross section except at its lowermost end which has one side milled away. A standard presser foot 13 is attached by means of a pin 14 to a clamp 16, which is connected, in turn, to the lower end of the presser bar 11 by means of a screw 17.

A presser bar guide bracket 18 is attached at or near the upper end of the presser bar 11 by means of a set screw 19. The presser bar guide bracket 18 is, in this embodiment, in the form of a block having a cylindrical channel 21 into which the upper end of the presser bar 11 extends. Surrounding the lower end of the channel 21 in the presser bar guide bracket 18 is an externally threaded member 22 that has a diameter and thread pitch such that the upper end of the spring 12 can be threaded onto it with some effort. A dog 23 extends from one face 24 of the block-shaped presser bar guide bracket 18. This presser bar guide bracket may be considered a first holding means for the helical extension spring 12.

A second holding means to hold the other end of the helical extension spring 12 comprises a presser bar spring tensioner 26 that consists of a block portion 27 and a second externally threaded member 28 extending upwardly from the upper surface 29 of the block 27 and threaded into the lower end of the helical spring 13. When a spring having twenty-two turns is used, three turns at each end may be threaded onto the members 22 and 28 but more or less turns can be threaded on to adjust the tension approximately. Another cylindrical channel 31 extends through the helically grooved member 28 and the block 27 and is of substantially the same cross sectional size and shape as the presser bar 11 but with just enough clearance so that the bar can move smoothly in a longitudinal direction in the channel 31. Two lugs 32 and 33 extend from opposite sides of the block 27 and fit into notches 34 and 36 at the lower ends of two arms 37 and 38, respectively of a presser bar pressure regulating bracket 39. This bracket is made of sheet metal in the present embodiment, and the arms 37 and 38 are bent so as to be perpendicular to a central portion 41 and substantially parallel to each other. A support member 42 is bent from the central portion 41 in a direction opposite from that in which the arms 37 and 38 are bent, and a base 43 is bent outwardly perpendicularly to the support 42. This base includes apertures 44 and 46 into which a stud 47 and a cam follower stud 48, respectively, are riveted.

The presser bar pressure regulating bracket 39 is mounted on a presser bar mounting bracket 49. The latter is also a sheet metal structure in this embodiment and comprises a central member 51 with two support members 52 and 53 that are bent perpendicularly to the central member 51 and substantially at opposite ends thereof. A base 54 having an aperture 56 is bent outwardly from the end of the support 52, and a base 57 having an aperture 58 is bent outwardly from the support 53. A spacer 59 is bent from the member 51 in the opposite direction from the supports 52 and 53 and has a guide member 61 with a threaded opening 62 and an elongated slot 63 in it. The length of the spacer 59, that is, the distance from the surface of the member 51 visible in FIG. 1 to the visible surface of the guide member 61, is substantially equal to that of the support 42. This allows the rear surface, i.e. the surface not visible in FIG. 1, of the base 43 to slide on the front, or visible, surface of the guide member 61 and the rear surface of the central portion 41 of the pressure regulating bracket 39 to slide on the front surface of the mounting bracket 49. The stud 47 and the cam follower stud 48 guided by the groove 63 constrain the presser bar pressure regulating bracket 39 to move only in one direction with respect to the presser bar mounting bracket 49 and are held in place by retaining rings 60 and 65. Another stud 64 riveted into an aperture 66 in the central member 41 of the presser bar pressure regulating bracket 49 extends into an elongated slot 67 in the member 51 of the presser bar mounting bracket 49 as a further aid in constraining the presser bar pressure regulating bracket 39 to move only back and forth in one direction and not to rotate with respect to the presser bar mounting bracket 53. A retaining ring 70 holds the stud 64 in the slot.

The presser bar spring 12 tends to pull the spring tensioner 26 and the guide bracket 18 as close together as possible. The ultimate degree of proximity would be obtained if the coils of the spring 12 could be in contact with each other, which is the condition in which the spring is wound. However, the mounting bracket 49 holds the guide bracket 18 and the spring tensioner 26 farther apart than that. The shouldered screw 19 extends through an elongated slot 67 near the upper end of the mounting bracket 49. The lowermost position of the presser bar guide bracket 18 is obtained when the shouldered screw 19 comes in contact with the lower end of the slot 67. The position of the presser bar spring tensioner 26 is determined by the position of the presser bar pressure regulating bracket 39, which, in turn, is controlled by a presser bar pressure regulating cam 68 acting on the cam follower stud 48.

The cam 68 may be molded of any suitable material, such as ABS Cycolac "T" or Lustran 400, for example as part of a molded presser bar pressure regulating dial 69 attached by a central, shouldered screw 71 to the presser bar mounting bracket 49. The screw 71 is screwed into the threaded hole 62 in the bracket 49, and the cylindrical part of the screw 71 serves as an axle for the dial 69. The pressure regulating cam 68 has a plurality of detent recesses 72 that are engaged by the cam follower stud 48 to hold the dial 69 in any one of several specific positions. The general configuration of the cam 68 is such that each successive detent position, as the cam is rotated in the direction of the arrow 73, allows the cam follower stud to move closer to the axis of the shouldered screw 71. This, in turn, permits the presser bar pressure regulating bracket 39 to move upward with respect to the mounting bracket 49 as the studs 47, 48, and 64 move upward in the slots 63 and 70 in response to tension in the presser bar spring 12. The cam 68 has two stops 74 and 75 that limit the rotation of the dial to slightly less than 180°.

The setting of the dial 69 determines the amount of pressure applied to the work when the presser foot 13 is in its operative position. However, the pressure dial does not rotate far enough to allow the presser foot 13 to move entirely away from the work. Such movement of the presser foot is accomplished by means of a presser foot lever 76 pivotally mounted on a shouldered stud 77 riveted into an aperture 78 in the central member 51 of the presser bar mounting bracket 49. The lever 76 has a cam surface 79 that includes a detent recess 81 and an additional portion 82 beyond the detent. A cam follower stud 83 riveted into an aperture 84 in a presser bar lifter lever link 86 transmits the pivotal movement of the lever 76 into a longitudinal movement of the link 86. The latter has two elongated slots 87 and 88. The shouldered stud 77 extends through the slot 87 so that the link 86 is free to move longitudinally in response to engagement of the cam follower 83 on the cam surface 79. The shouldered screw 19 passes through the upper elongated slot 88. The slots 86 and 88 allow the presser foot 13 to ride over seams without lifting the link 86.

The lever 76 is shown in its normal, or operative, position, which is the position it occupies when the presser foot 13 is in engagement with the work. In this condition, the spring 12 pulls the link 86 downwardly by urging the shouldered screw 19 against the lowermost end of the slot 88 and pressing the uppermost end of the slot 87 against the shouldered screw 77.

When the presser foot 13 is to be raised from the work, the lever 76 is moved in the direction of an arrow 89. This causes the cam follower 83 to be lifted by the cam surface 79, which causes the link 86 to move upwardly. The link is prevented from pivoting or moving in any other direction than the up and down direction by the shouldered stud 77 and the shouldered screw 19, which engage the sides of the elongated slots 87 and 88, respectively. The link 86 transmits the upward motion of the cam follower 83 to the presser bar guide bracket 18 and thus lifts it, as well as the presser bar 11, upwardly away from the work. This stretches the presser bar spring 12, so that release of the lever 76 would allow the spring to pull the guide bracket 18 down until the shouldered screw 19 either reached the bottom of the elongated slot 67 or it reached the bottom of the elongated slot 88 and the top of the elongated slot 87 reached the shouldered rivet 77. Either of those conditions will limit the lowermost position of the presser bar guide bracket 18.

The presser bar 11 would not be adequately constrained by the spring tensioner 26 acting as a bushing. Therefore, a fixed bushing 91 is mounted on the presser bar mounting bracket 49. The bushing 91, in this embodiment, is a block with a channel 92 shaped to fit closely around the cylindrical presser bar 11 but with just enough clearance to allow the presser bar to slide smoothly therein. The bushing 91 is preferably molded of a material having a low coefficient of friction, such as Delrin 500 or Celcon M90-04, which is also a suitable material for the spring tensioner 26. The bushing 91 has two pins 93 and 94 extending from its rear surface 95 to fit into guide holes 96 and 97, respectively, in the mounting bracket 49. The bushing 91 also has an integrally molded side flange 98 with an aperture 99. The distance from the rear surface 95 of the bushing 91 to the rear surface 102 of the flange 98 is substantially equal to the height of the support member 52 from the visible surface of the central member 51 to the visible surface of the base 54. Furthermore, the aperture 99 is formed so as to be substantially directly aligned with the aperture 56 when the pins 93 and 94 are in the holes 96 and 97.

All of the units described to this point are mounted on a plate 103 to be attached as a preassembled structure to the arm of a sewing machine. The plate 103 has a rectangular opening 104 and a threaded hole 106 along side it. The rectangular opening 104 is shaped to fit the end 105 of the bushing 91, and the threaded hole 106 is located to be aligned with the apertures 56 and 91 to receive a machine screw 107 to hold one end of the mounting bracket 49 and the bushing 91 firmly in place on the plate 103. The other end of the bracket 49 is held in place by another machine screw 108 through the aperture 58 in the base 57 and screwed into a threaded hole 109 in the plate 103. Thus, only two screws 107 and 108 are needed to hold all of the parts in place on the plate 103. When these parts are so assembled, the dog 23 is in position to slide within a slot 111. The presser bar guide 18 of which the dog 23 is an integral part is machined of metal, and in order to minimize friction, the slot 111 is defined within an elongated border 112 of low-friction material, such as Delrin or Celcon, similar to the bushing 91 and the tensioner 26.

Figure 2:
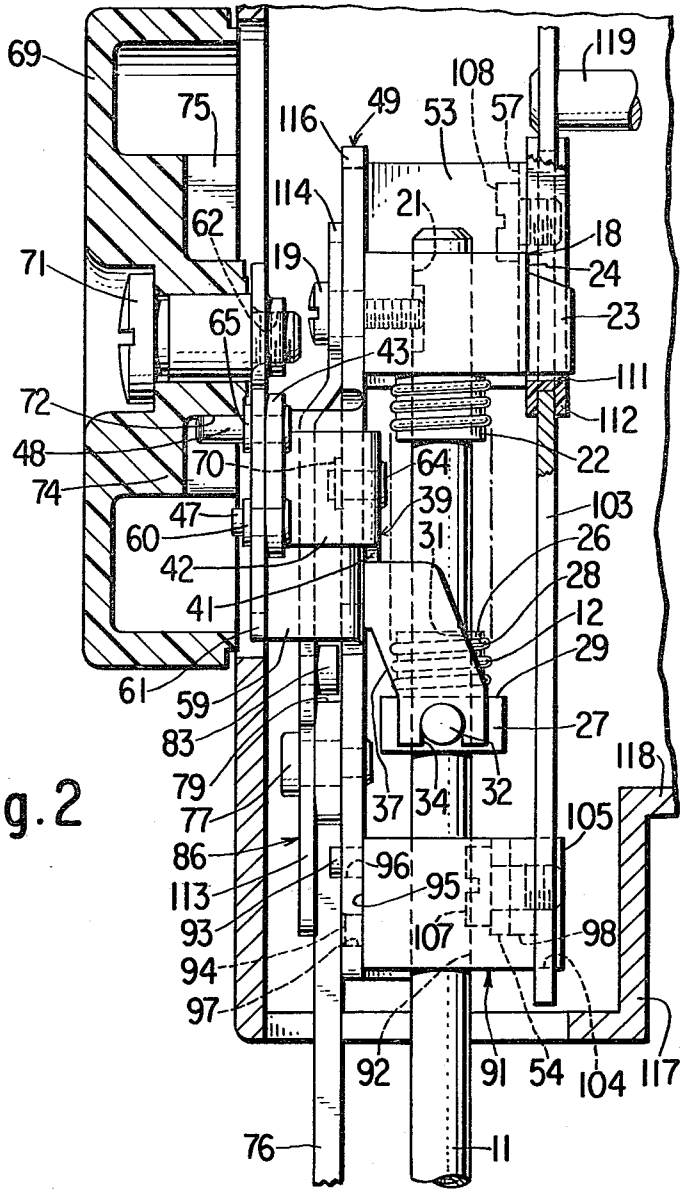
FIG. 2 is a front view of the head end of a sewing machine incorporating the mechanism of FIG. 1.

FIG. 2 shows the components of FIG. 1 assembled into a presser bar control system. As may be seen, the link 86 has a lower end 113 that is offset from the upper end 114. The latter is directly against one surface 116 of the mounting bracket 49, while the lower end 113 is spaced from the mounting bracket by a distance equal to the thickness of the lever 76 in the region of its axle, the shouldered rivet 77. The components are, for the most part, mounted in a head 117 at the end of an arm 118 of a sewing machine. The plate 103 is mounted in any suitable manner, and one of the parts of the mounting structure for the plate is a rod 119, only one end of which is shown in the drawing.

Figure 3:
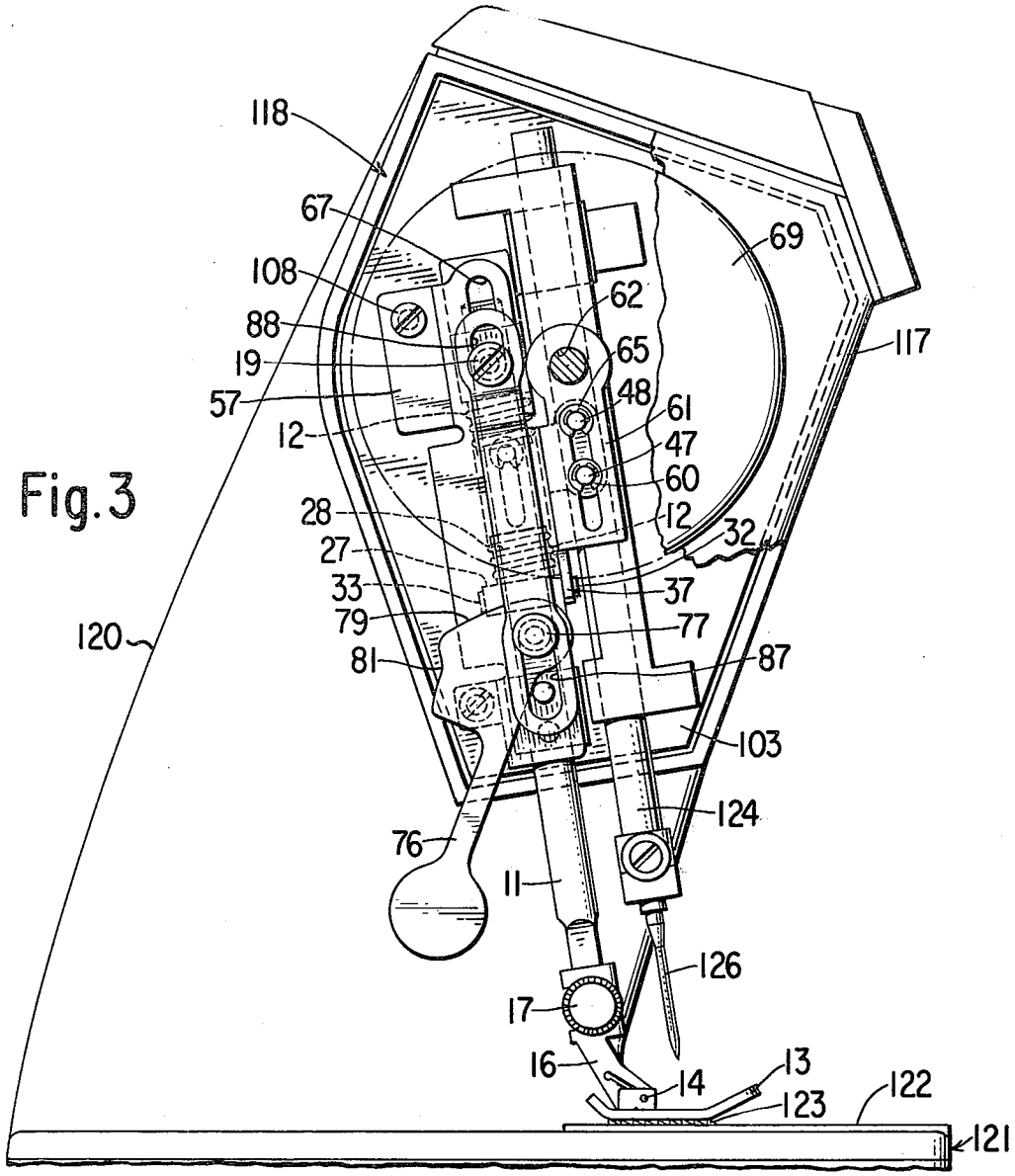
FIG. 3 is a side view of the head end of the machine shown in FIG. 2, partly in cross section to illustrate the presser bar in the position occupied when the machine is operating.

FIG. 3 not only shows an end view of the head 117, but also shows a standard 120 that supports the arm 118 (FIG. 2) the standard 120 extends upwardly from a bed 121, the upper surface of which is flat. A throat plate 122 and a feed dog 123 are mounted in the usual way in the bed 121.

In addition to the presser bar 11 and the apparatus to control its position, FIG. 3 also shows a needle bar 124 carrying a needle 126 at its lower end. The apparatus to actuate the needle bar 124 in its usual reciprocating motion is not part of the present invention and need not be described.

In FIG. 3, the lever 76 is in its operative position, that is, the position in which the presser foot 113 is in its lowest position, which is the low position with the foot in position to press work against the feed dog 123 of the machine. In this position, the shouldered screw 19 is against the lower end of the slot 88 in the link 86, and the link is thus pulled down by the spring 12 to force the cam follower 83 against the cam surface 79 of the lever 76.

Figure 4:
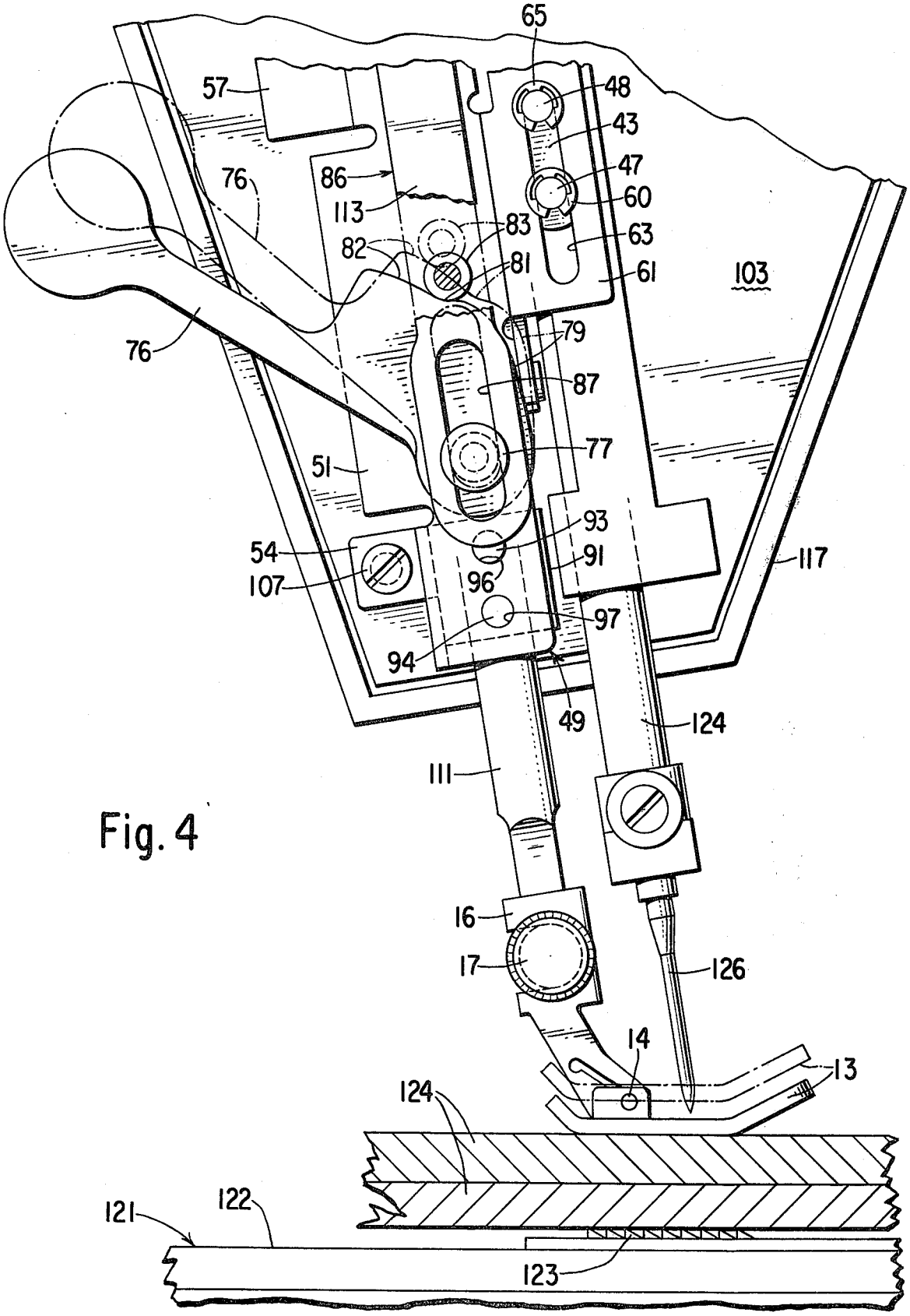
FIG. 4 is a view corresponding to FIG. 3 but with the presser bar and presser foot raised.

FIG. 4 shows a fragment of the machine in FIG. 3 with the lever 76 in its inoperative, or raised, position. Due to pressure of the cam surface 79 against the cam follower 83, the link 86 has been forced upward, causing the presser bar guide bracket 18 to be raised, thereby lifting the presser bar 11. This provides space under the presser foot 13 to allow work 124 to be moved easily between the presser foot and the throat plate 122.

In FIG. 4, the position of the lever 76 shown in solid lines is such that the cam follower 83 rests in the detent recess 81. The pressure of the cam follower 83 against the detent surface will keep the lever 76 in this position until it is delibrately moved to another position, usually the position shown in FIG. 3. However, it is possible to move the lever 76 to a still higher position, illustrated in broken lines, in which the section 82 of the cam surface on the lever is in contact with the cam follower 83. Under such circumstances, the presser foot 13 is lifted to a still higher position, as illustrated in broken lines, to allow a somewhat thicker stack of material to be placed between it and the throat plate 122. The cam surface shown in FIG. 4 does not have a detent recess to hold the lever 76 in its most extreme position illustrated in broken lines, although a detent recess could be provided for that purpose if necessary. However, it is considered that the lever 76 would not often have to be raised to this extreme position and that merely raising it sufficiently to allow the follower 83 to drop into the detent recess 81 would normally be sufficient.

While this invention has been described in terms of a specific embodiment, it will be understood by those skilled in the art that modifications may be made therein within the true scope of the invention as defined by the following claims.

We claim:

1. A presser bar mechanism for a sewing machine, the mechanism comprising:

a cylindrical presser bar reciprocally movable in its axial direction and having first and second presser bar ends, the first end comprising means to attach a presser foot thereto;

a helical extension spring surrounding a region of the presser bar between the first and second presser bar ends and having first and second spring ends nearer the first and second presser bar ends, respectively;

first holding means to hold the second spring end at a first location on the presser bar nearer the second presser bar end than the first presser bar end;

second holding means to hold the spring so that the spring is substantially concentric with respect to the presser bar and so that the first spring end is at a location closer to the first presser bar end than is the first location;

a bracket;

first attachment means to attach one of the holding means to the bracket; and second attachment means to attach the other of the holding means to the bracket, at least one of the attachment means comprising slidably movable means to allow one of the holding means to slide relative to the other of the holding means parallel to the axial direction of the presser bar.

2. The presser bar mechanism of claim 1 in which the first holding means comprises a first threaded member onto which the second spring end is threaded, and the second holding means comprises a second threaded member onto which the first spring end is threaded.

3. The presser bar mechanism of claim 1 in which the bracket comprises an elongated slot extending parallel to the presser bar and the first attachment means comprises a head wider than the slot and a portion having a cross section narrower than the slot to slide within the slot and be guided by the edges of the slot.

4. The presser bar mechanism of claim 1 comprising, in addition, bushing means mounted on the bracket and comprising a channel through which the presser bar extends, the portion of the presser bar extending through the channel substantially filling the channel to constrain the movement of the presser bar to the axial direction thereof.

5. The presser bar mechanism of claim 1 in which the second attachment means comprises first and second arms engaging opposite sides of the second holding means from a direction between the first and second holding means to exert pressure on the second holding means to prevent the spring from pulling the second holding means toward the first holding means.

6. The presser bar mechanism of claim 5 in which the bracket comprises an elongated slot extending parallel to the presser bar, and the second attachment means comprises a stud rigidly attached to the second attachment means and extending through the elongated slot in the first-named bracket to be guided by edges of that slot.

7. The presser bar mechanism of claim 6 in which the first-named bracket comprises:

a central member;

a guide member extending from the bracket;

a second elongated slot in the guide member and extending parallel to the first-named slot;

a cam follower stud rigidly attached to the second attachment means and extending through the second elongated slot to be guided by the edges thereof; and, a presser bar pressure regulating cam mounted on the bracket and in operative engagement wit the cam follower stud.

8. The presser bar mechanism of claim 1 in which the presser foot is moved into an operative position in response to the force of the helical extension spring pulling the first and second holding means closer together, and the presser foot has an inoperative position to which it moves when the first and second holding means are moved a predetermined distance apart, the presser bar mechanism further comprising:

a lever;

pivotal mounting means for the lever; and linkage means connecting the lever to one of the holding means to move that holding means between a first position and a second position when the lever moves between a first pivotal position and a second pivotal position.

9. The presser bar mechanism of claim 8 in which the lever comprises a cam surface and the linkage means comprises a cam follower that engages the cam surface of the lever to be moved thereby when the lever pivots between its first pivotal position and its second pivotal position, the linkage means being connected to the first holding means to move the first holding means away from the second holding means and thereby to extend the helical extension spring when the lever moves from its first pivotal position to its second pivotal position.

10. The presser bar mechanism of claim 9 in which the cam surface comprises:

a detent recess engaged by the linkage means when the lever is in its second pivotal position corresponding to the presser foot being in its inoperative position; and a surface portion beyond the detent and shaped to force the linkage to move the presser foot even farther away from its operative position when the lever is forced beyond its second pivotal position.

11. A presser bar mechanism for a sewing machine, the mechanism comprising:

a cylindrical presser bar reciprocally movable in its axial direction and having a first and second presser bar ends, the first end comprising means to attach a presser foot thereto;

a helical extension spring surrounding a region of the presser bar between the first and second presser bar ends and having first and second spring ends nearer the first and second presser bar ends, respectively;

first holding means to hold the second spring end at a first location on the presser bar nearer the second presser bar end than the first presser bar end;

second holding means to hold the spring so that the spring is substantially concentric with respect to the presser bar and so that the first spring end is at a location closer to the first presser bar end than is the first location;

a presser bar pressure regulating cam;

a cam follower connected to the second holding means and engaging the presser bar pressure regulating cam to adjust the location of the second holding means and thereby the tension in the extension spring when the presser foot is in an operative lower position and the distance between the first and second holding means is at a minimum for the particular setting of the presser bar pressure regulating cam;

a bracket comprising an elongated slot parallel to the presser bar;

attachment means slidably mounted on the bracket and connected to the second holding means, the cam follower being attached to the attachment means to slide the attachment means along the slot with respect to the bracket and thereby to adjust the location of the second holding means in response to operative motion of the cam; wherein the bracket comprises a second elongated slot parallel to the first-named slot, the cam follower extending through the second slot and into engagement with the presser bar pressure regulating cam.

12. The presser bar mechanism of claim 11 in which the bracket comprises a third elongated slot parallel to the first-named and second elongated slots, the mechanism comprising, in addition:

a retaining means attached to the first holding means and extending through the third slot, the retaining means comprising a head wider than the third slot to retain the first holding means in operative, sliding relationship with respect to the bracket;

a lever to control the position of the presser bar between an inoperative position and an operative position; and linkage means connecting the lever to the retaining means to move the retaining means in the third slot and thereby move the first holding means relative to the second holding means to change the distance between the first and second holding means and, thereby, to increase the tension in the spring when the lever is moved to its inoperative position, the presser bar being moved to an inoperative position simultaneously with such movement of the lever.

13. The presser bar mechanism of claim 12 comprising, in addition:

a plate;

mounting means to mount the bracket rigidly on the plate, the plate comprising an additional elongated slot, the first holding means comprising a dog extending into the additional slot to move therein when the lever moves between its operative and inoperative positions, the dog being guided by the sides of the additional slot.

* * * * *